US005333858A

United States Patent [19]

Fagot

[11] Patent Number: 5,333,858

[45] Date of Patent: Aug. 2, 1994

[54] RACKET FOR TENNIS OR THE LIKE

[75] Inventor: Jacques Fagot, Saint Jean de Moirans, France

[73] Assignee: Skis Rossignol S.A., France

[21] Appl. No.: 59,678

[22] Filed: May 12, 1993

[30] Foreign Application Priority Data

May 14, 1992 [FR] France ..... 92 06085

[51] Int. Cl.[5] ..... A63B 49/02

[52] U.S. Cl. ..... 273/73 G; 273/73 R; 273/73 C

[58] Field of Search ..... 273/73 R, 73 C, 73 G

[56] References Cited

U.S. PATENT DOCUMENTS 4,082,274 4/1978 Stevens .
4,725,059 2/1988 Du Gardin et al. ..... 273/73 G
4,983,242 1/1991 Reed .
5,005,834 4/1991 Ferrari et al. .
5,174,568 12/1992 You ..... 273/73 G X

FOREIGN PATENT DOCUMENTS 3731529 3/1989 Fed. Rep. of Germany .
8902296 3/1989 World Int. Prop. O. ..... 273/73 R

*Primary Examiner*—V. Miller
*Assistant Examiner*—Raleigh W. Chiu
*Attorney, Agent, or Firm*—Parkhurst, Wendel & Rossi

[57] ABSTRACT

A racket for tennis or the like, including of a shaft (1) aligned in the median longitudinal axis (I,I') of a flat head, this head comprising a frame (5) intended to receive strings for forming the stringing, connected to the shaft (1) by two branches (3,4) in a V, defining a neck (8). The neck (8) includes at least two ties joining the two branches (3,4) of the V, respectively a main tie (10) located at the junctions (11,12) of each of the two branches (3,4) of the V with the bottom (10) of the frame (5), and at least one intermediate tie located between the main tie (10) and the meeting point of the branches. The intermediate tie (15) is inclined with respect to the perpendicular to the median longitudinal axis (I-I'), and in that the points (16,17) of attachment of this intermediate tie (15) on each of the two branches (3,4) are asymmetric.

10 Claims, 4 Drawing Sheets

RACKET FOR TENNIS OR THE LIKE

BACKGROUND OF THE INVENTION

The invention relates to a novel improved racket for tennis or the like, for example for playing squash, badminton, etc.

As is known, in general, a tennis racket comprises a shaft aligned in the median longitudinal axis of a flat head, this head comprising a frame intended to receive the stringing, connected to the shaft by two branches in a V defining an open neck, delimited by the two branches of the V and by a tie located at the junction of the branches and of the bottom of the frame. Such a racket is described for example in document U.S. Pat. No. 4,082,274.

In U.S. Pat. No. 4,983,242, the neck comprises several successive ties, respectively a main tie located at the junction of the branches and of the bottom of the frame, and several parallel intermediate ties, located between the main tie and the end of the handle. These intermediate ties are intended to reinforce the shaft in the region of the branches in order to limit the bending thereof.

In U.S. Pat. No. 5,005,834, a racket is proposed whose neck has two pairs of crossed intermediate ties, whose points of attachment onto the branches are symmetrical with respect to the median longitudinal axis of the racket. These intermediate ties are intended to rigidify the neck and the frame. However, this arrangement has the same drawbacks as before.

In DE-A-3,731,529, a tennis racket is described whose single tie is inclined with respect to the median longitudinal axis. In this way, the stringing has an asymmetric shape giving the longitudinal so-called "rising" strings different lengths between the part situated to the left of the longitudinal axis passing through the handle, and the part situated to the right of this axis. This arrangement essentially aims at enlarging and offsetting the percussion zone (sweet spot) on one side of the racket. Although the enlargement of the "sweet spot" makes it possible to improve the tolerance of the racket, this offset may on the other hand be a handicap for the player.

SUMMARY OF THE INVENTION

The invention relates to a racket of the type in question with an intermediate tie which has a better effect of damping the vibrations during impact.

This improved racket for tennis or the like, includes of a shaft aligned in the medians longitudinal axis of a flat head. The head comprises a frame intended to receive strings for forming the stringing, connected to the shaft by two branches in a V defining a neck. The head comprises at least two ties joining the two branches of the V, respectively a main tie located at the junctions of each of the two branches with the bottom of the frame, and at least one intermediate tie located between the main tie and the meeting point of the two branches. The intermediate tie is inclined with respect to the perpendicular to the median longitudinal axis, in that the points of attachment of this intermediate tie on each of the two branches are asymmetric.

In other words, the invention consists in arranging the intermediate tie of the open neck no longer parallel to the main tie, but inclined with respect to the latter and with respect to the perpendicular to the median longitudinal axis, so that the position of the points of attachment of the intermediate tie with each of the branches forming the neck is asymmetric with respect to the median longitudinal axis of the racket. In this way, the vibrational waves which are propagated in each of the branches are damped by phase-shifting when they arrive in the region of the handle of the shaft. This leads to better comfort and therefore a lower degree of fatigue for the sports competitor.

Advantageously, in practice:

- the intermediate tie is inclined by 15 to 60 degrees, and preferably in the vicinity of 20 degrees, with respect to the perpendicular of the median longitudinal axis;
- the intermediate tie is located in the middle and is perpendicular to one of the branches forming the neck;
- one end of this intermediate tie is situated in the middle of one of the branches forming the neck, whereas the other end bears at the point of junction of the main tie with the other branch forming this neck;
- the cross-section of the intermediate tie is constant;
- the cross-section of the intermediate tie is the same as that of the main tie and/or of the branches;
- the intermediate tie is wider and/or thicker than the main tie and/or the branches;
- the intermediate tie is made at least partly of a material having viscoelastic properties, such as for example of a polyether-amide block copolymer or a polyamide or a thermoplastic polyurethane;
- the intermediate tie is straight or curved;
- the cross-section of the intermediate tie varies along its length;
- one of the ends of the intermediate tie attaches to the main tie.

BRIEF DESCRIPTION OF THE DRAWINGS

The manner in which the invention may be produced, and the advantages which stem therefrom, will emerge better from the embodiment which follows, in the light of the attached figures.

DETAILED DESCRIPTION OF THE INVENTION

Figure 1:
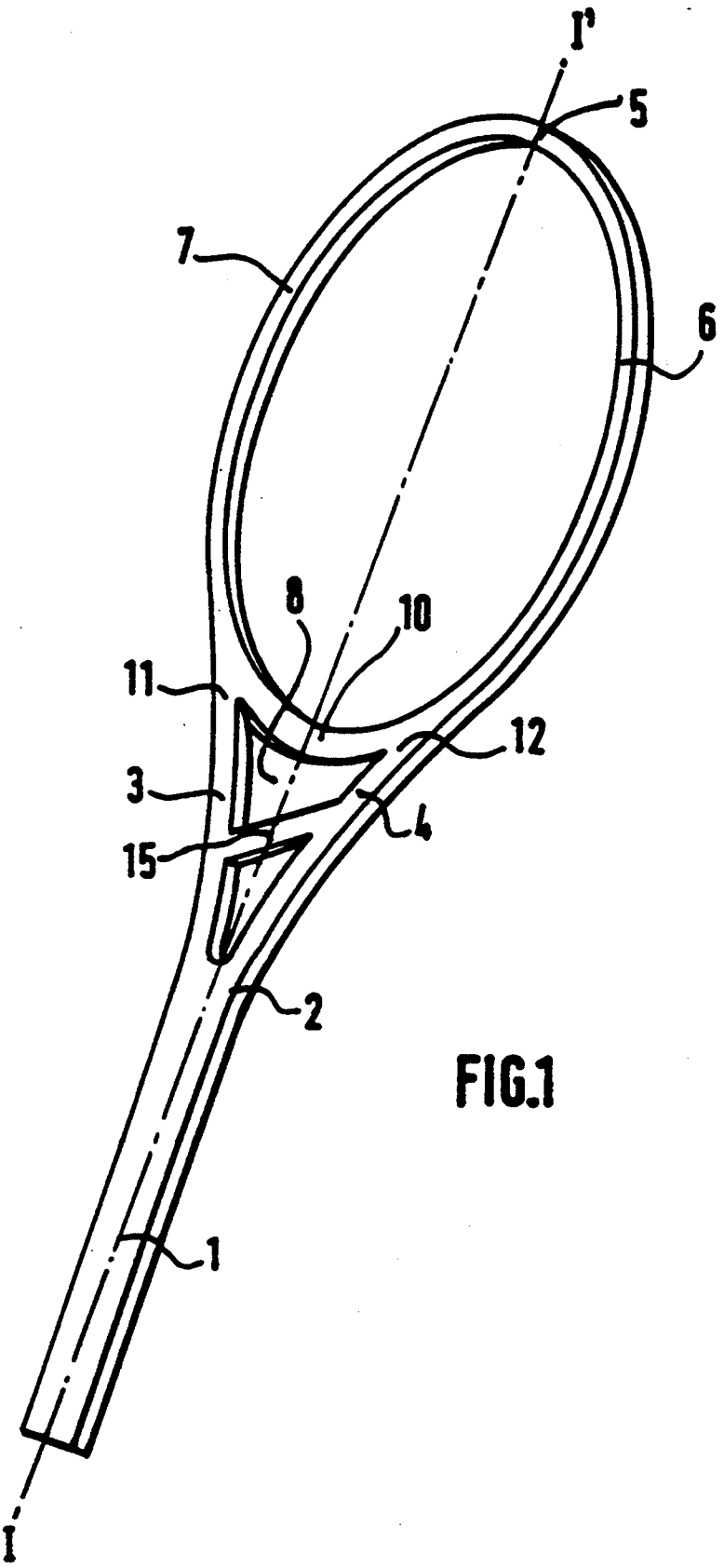
FIG. 1 is an overview diagrammatic perspective representation of a first embodiment of a racket according to the invention, whose characteristic neck is shown in detail in FIG. 2.

Referring to FIG. 1, the tennis racket according to the invention comprises a handle shaft (1) shown here uncovered, at a lower end thereof whose top end (2) constitutes a joining region between two branches formed in a V, respectively (3) and (4) connected to the head frame (5), intended to receive the stringing which is not shown. The median longitudinal axis (I,I') of the racket, which passes through the handle (1), defines two respectively right (6) and left (7) head frame halves. The head (5) is joined to the branches (3,4) forming the neck (8) in the region of the ends (11) and (12) of the main tie (10).

Figure 2:
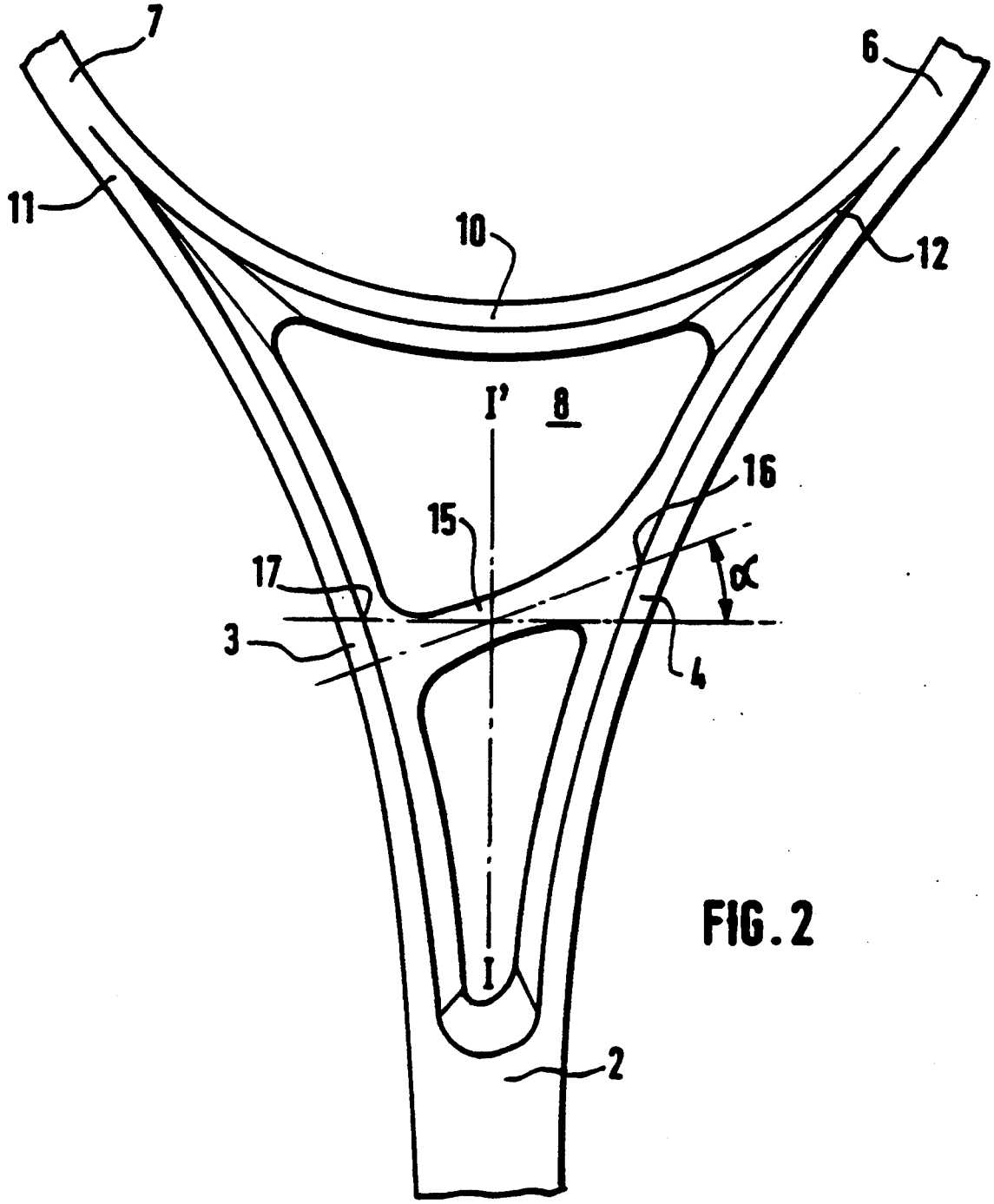

According to the invention, the neck (8) comprises substantially in its middle, another intermediate tie (15) inclined by an angle (a) of twenty degrees with respect to the perpendicular to the median longitudinal axis (I-I'). The point (16) of the junction of this itermediate tie (15) on the branch (4) is nearer to the end (12) of the main tie (10) than the junction (17) on the opposite branch (3) (see FIG. 2).

Figure 3:
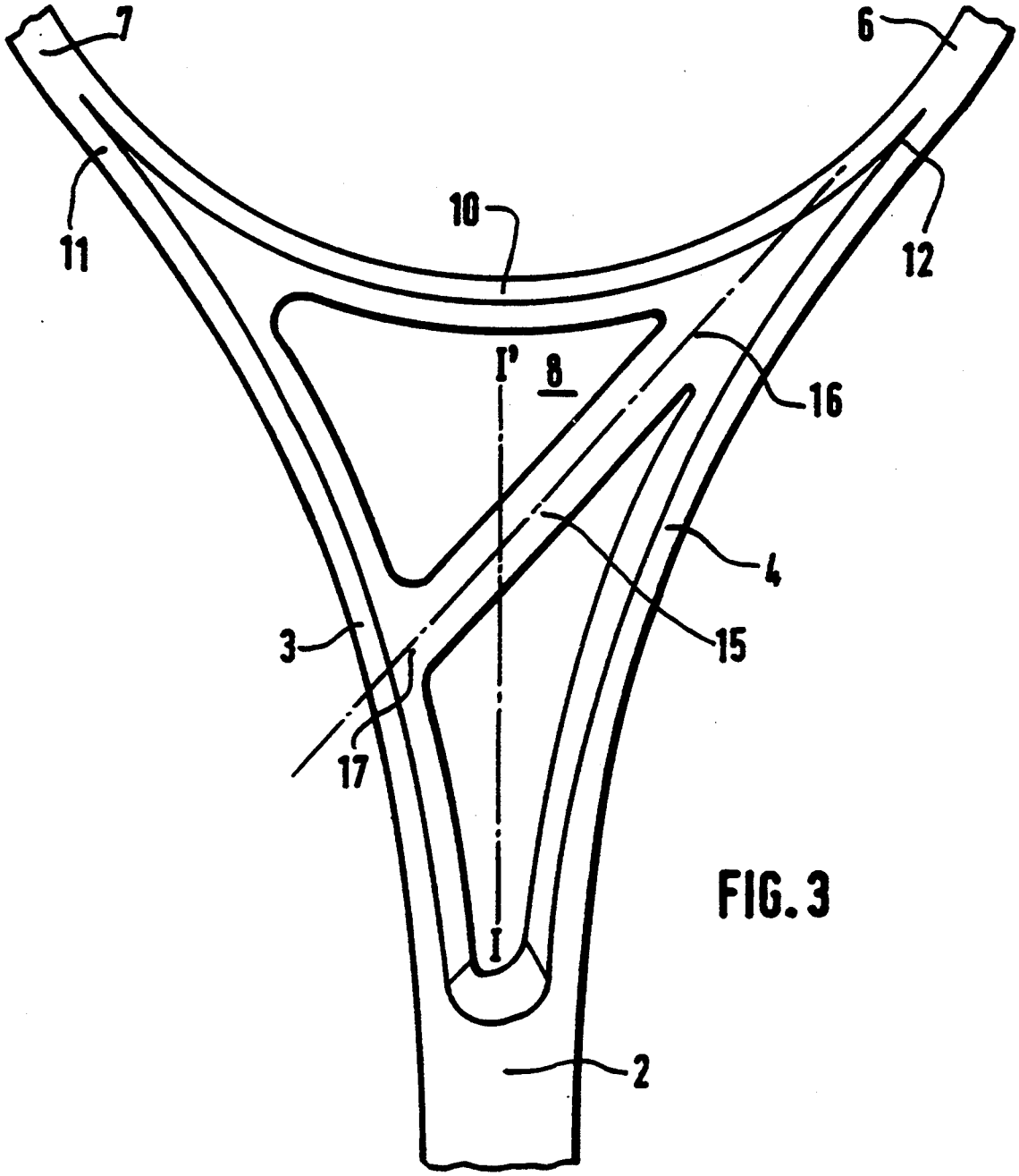
FIG. 3 is a detail representation of another embodiment of the invention.
Figure 4:
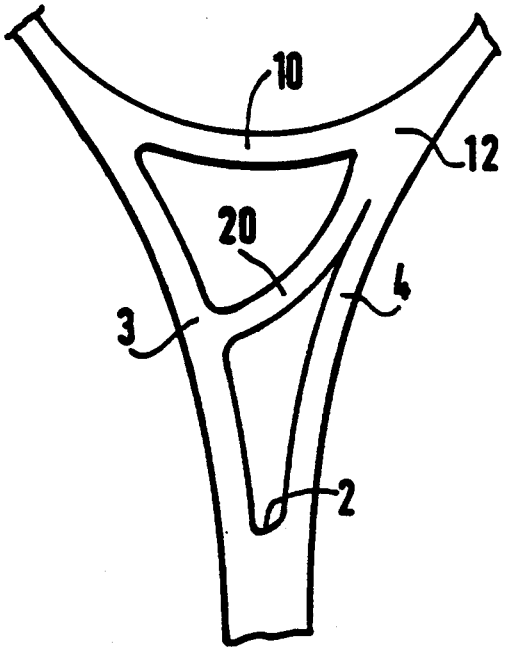
FIGS. 4 to 7 are diagrammatic representations of other embodiments of the invention.
Figure 5:
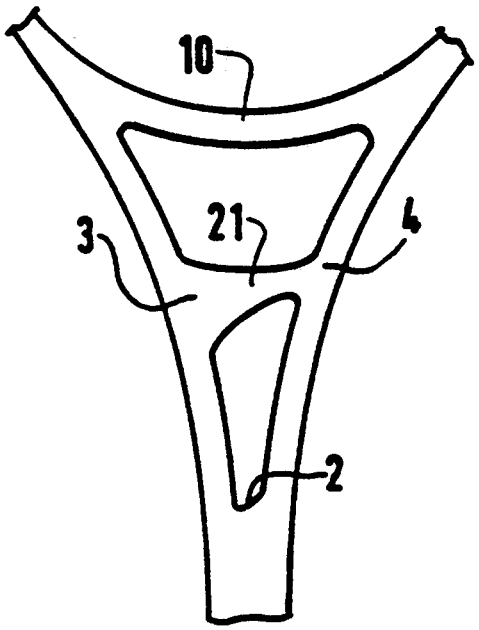
Figure 6:
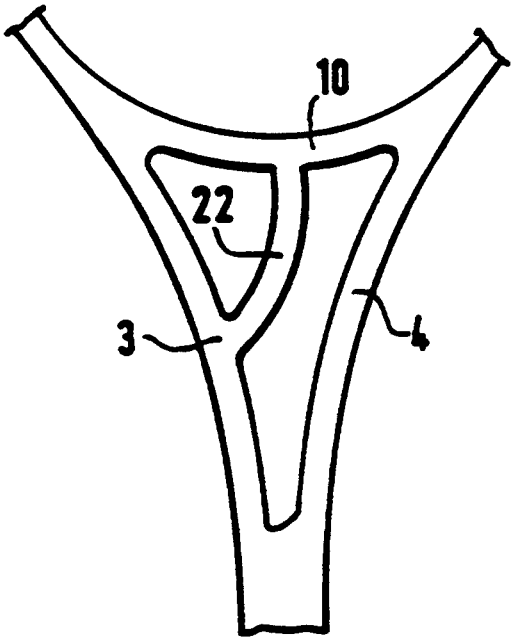

In the embodiment shown in FIG. 3, the neck (8) comprises an intermediate tie also designated by the reference (15), but one of whose ends (17) is situated substantially in the middle of the branch (3) of the neck, whereas the other end (16) merges with the point of intersection (12) of the main tie (10) and of the other branch (4) of the neck.

Thus, when the ball is struck, the vibrational waves generated by the impact are propagated first of all in the two head halves (6,7), then from there into the branches (3,4) as far as the junction (16,17) with the characteristic intermediate tie (15). A portion of the waves then continues to progress in the branches (3,4), and another part follows the intermediate tie (15), thus causing a phase-shifting of these waves. Furthermore, since the points (16,17) of attachment of the intermediate tie (15), (forming a bearing point) on the branches (3,4) of the neck are no longer symmetrical, the rigidity is then different on each of these two branches, which leads in turn to a decrease in the amplitudes, and therefore damping of the resonance in the region of the top of the shaft (2), which improves the comfort for the user.

Figure 7:
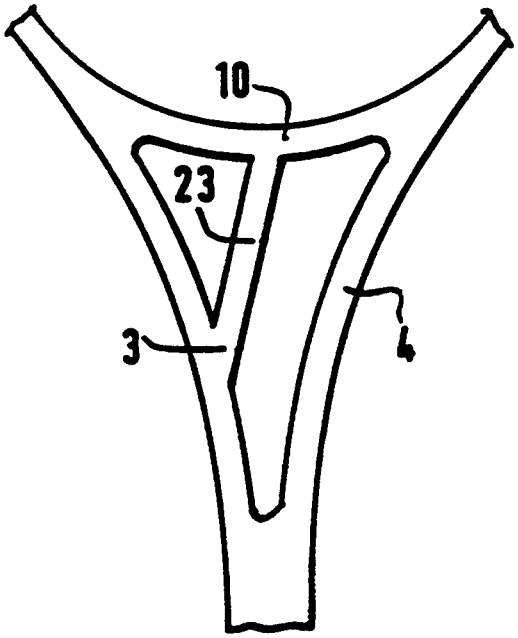

FIGS. 4 to 7 illustrate other embodiments of the invention, in which, respectively:

the intermediate tie (20) (FIG. 4) is curved and meets the main tie (10) at (12);

the intermediate tie (21), (FIG. 5), has a variable cross-section which decreases from the left-hand branch (3) to the right-hand branch (4);

the intermediate tie (22) (see FIG. 6) joins the middle of the left-hand branch to the middle of the main tie (10) in a curve;

the intermediate tie (23) joins, as before (FIG. 7), the middle of the left-hand branch (3) to the middle of the tie (10), but it is straight (FIG. 7).

Although the embodiment has been described with reference to a tennis racket, it is obvious that this racket can be used for other ball games, such as squash, badminton or the like.

I claim:

1. A racket for hitting a ball, comprising:

a head frame for receiving strings to contact a ball;

a neck joined to and extending from said head frame and comprising two converging branches joined together at a joining region spaced from said head frame;

a longitudinal handle shaft extending from said joining region of said branches in alignment with a median longitudinal axis of said head frame and said racket as a whole;

a main tie portion of said head frame located at a junction of each said branch with said head frame and linking said two branches of said neck; and means for damping vibrations transmitted from said head frame to said handle shaft, said means consisting of one secondary tie located between said main tie and the joining region of said branches, said secondary tie being inclined with respect to a plane perpendicular to said median longitudinal axis and attached to each said branch at points asymmetric with respect to said median longitudinal axis.

2. The racket of claim 1, wherein said secondary tie is located substantially in the middle between said main tie and the joining region of said branches, and is perpendicular to one of said branches.

3. The racket of claim 1, wherein said secondary tie is inclined at 15 to 60° with respect to said plane perpendicular to said median longitudinal axis.

4. The racket of claim 1, wherein one of the ends of said secondary tie is joined to about the middle of one of said branches, whereas the other end of said secondary tie is joined to and merges with a junction between said main tie and the other of said branches.

5. The racket of claim 1, wherein the cross-section of said secondary tie is about the same as that of said main tie.

6. The racket of claim 1, wherein said secondary tie is at least one of wider and thicker than said main tie.

7. The racket of claim 1, wherein said secondary tie comprises a material having viscoelastic properties.

8. The racket of claim 1, wherein said secondary tie is curved.

9. The racket of claim 1, wherein said secondary tie has a cross-section which varies.

10. A racket for hitting a ball, comprising:

a head frame for receiving strings to contact a ball;

a neck joined to and extending from said head frame and comprising two converging branches joined together at a joining region spaced from said head frame;

a longitudinal handle shaft extending from said joining region of said branches in alignment with a median longitudinal axis of said head frame and of said racket as a whole;

a main tie portion of said head frame located at a junction of each said branch with said head frame and linking said two branches of said neck; and means for damping vibrations transmitted from said head frame to said handle shaft, said means consisting of one secondary tie located between said main tie and the joining region of said branches and linking one of said branches and said main tie, said secondary tie being inclined with respect to a plane perpendicular to said median longitudinal axis and attached to said one branch and said main tie at points asymmetric with respect to said median longitudinal axis.

* * * * *